US007118019B2

(12) United States Patent
Marks

(10) Patent No.: US 7,118,019 B2
(45) Date of Patent: Oct. 10, 2006

(54) JAM RESISTANT STAPLE HOLDING TRACK FOR STAPLERS

(75) Inventor: Joel Marks, Sherman Oaks, CA (US)

(73) Assignee: WorkTools, Inc., Chatsworth, CA (US)

( * ) Notice: Subject to any disclaimer, the term of this patent is extended or adjusted under 35 U.S.C. 154(b) by 45 days.

(21) Appl. No.: 10/732,029

(22) Filed: Dec. 11, 2003

(65) Prior Publication Data

US 2005/0127129 A1 Jun. 16, 2005

(51) Int. Cl.
*B25C 1/06* (2006.01)

(52) U.S. Cl. ..... 227/119; 227/134

(58) Field of Classification Search ..... 227/134, 227/119, 109, 120, 136, 129, 140, 155, 148, 227/156

See application file for complete search history.

(56) References Cited

U.S. PATENT DOCUMENTS

| | | | | |
|---|---|---|---|---|
| 2,142,782 A | | 1/1939 | Gillette | |
| 2,421,429 A | | 6/1947 | Obstfeld | |
| 2,733,440 A | | 2/1956 | Jenny | |
| 3,198,412 A | * | 8/1965 | Roosa | 227/8 |
| 3,633,811 A | * | 1/1972 | Ploen | 227/109 |
| 4,206,863 A | | 6/1980 | Savino | |
| 4,340,331 A | * | 7/1982 | Savino | 411/457 |
| 4,552,296 A | * | 11/1985 | Sheng | 227/109 |
| 4,598,852 A | | 7/1986 | Olesen | |
| 4,763,824 A | * | 8/1988 | Ebihara | 227/120 |
| 5,605,269 A | * | 2/1997 | Musiani | 227/109 |
| 5,794,832 A | * | 8/1998 | Chen | 277/109 |
| 5,931,364 A | * | 8/1999 | Dennis | 227/109 |
| 6,012,623 A | * | 1/2000 | Fealey | 227/134 |
| 6,059,165 A | * | 5/2000 | Deng | 227/109 |
| 6,076,720 A | * | 6/2000 | Deng | 227/109 |
| 6,360,933 B1 | * | 3/2002 | Richardot et al. | 227/109 |

FOREIGN PATENT DOCUMENTS

DE 197 12 849 A 10/1998

OTHER PUBLICATIONS

Marks, Pending patent application for "Spring Energized Desktop Stapler", Serial No. 10/443854.

* cited by examiner

*Primary Examiner*—Scott A. Smith
(74) *Attorney, Agent, or Firm*—Paul Y. Feng; Fulwider Patton LLP

(57) ABSTRACT

An anti-jamming design for a stapler track provides reduced force to shear a staple from a rack of staples. In stapling, a front staple must be separated from a rack of staples to eject the staple out. Conventional staplers shear the glue that holds the staples together all at once, so the peak force to separate the staple is high. In the present invention the glue that holds staples together in a rack is sheared by a peeling action. Locally progressing sections of glue are peeled as the front staple is sheared from the adjacent second staple. According to one embodiment of the invention progressive shearing is provided by an asymmetric track front end, whereby the front staples are fully supported on one side only so that the staple rack twists as the striker slowly presses down. The striker contacts the supported, higher, side of the staple first and the staple begins to shear from this higher side. When used in a low force spring actuated stapler, the present invention prevents the striker from resting atop the staple in an energized state if the stapling cycle is not properly completed.

14 Claims, 3 Drawing Sheets

JAM RESISTANT STAPLE HOLDING TRACK FOR STAPLERS

FIELD OF THE INVENTION

The present invention relates to desktop staplers. More precisely the present invention discloses improvements to a staple feeding system.

BACKGROUND OF THE INVENTION

For consumer applications staples are used in both staple guns and desktop staplers. Both may be referred to as staplers. Staple guns usually employ a heavier staple and stapling mechanism than desktop staplers, and do not include a separate base and anvil element. However desktop staplers may also be of a heavy-duty format if intended for large stacks of paper. Standard light duty staplers typically fasten a maximum of 20 sheets of paper.

The staples are provided in a rack that includes a line of staples glued together edge-to-edge. The strength of the glue must be sufficient to hold the rack together during handling and use of the staples. The staples are held in or on a track; a front most staple extends past the track to a position under a striker. The striker shears off the front staple so that the staple can be ejected out if the stapler. The glue that holds the rack together must not be too strong or it will require excessive force to separate the front staple by shearing. The consistency of the glue that holds the staples in the rack is an important part of manufacturing staples.

In a direct action stapler, where a handle is directly linked to the striker, a user must directly overcome the staple rack glue shear force needed to separate the front staple. Direct action is typical in desktop staplers. The shear force can be a large part of the apparent effort of such stapling. In a spring-actuated stapler the impact action makes the user unaware of the shearing step of ejecting a staple. The fast moving spring is plenty strong enough to overcome the shear strength of the glue. In any spring actuated stapler the energy of the striker after it released is far more than required for shearing a normal staple.

Co-pending U.S. patent application Ser. No. 10/443,854 shows a light duty spring actuated desktop stapler. The disclosure is incorporated herein in its entirety by reference. In a light duty spring actuated desktop stapler the spring may not be strong enough to shear the staple if the handle is not pressed far enough to release the striker. In this case the striker has no momentum, but rather presses the staple with just the static force generated from deflection of the spring. The design of the above referenced application is very efficient. This of course is desirable to make an easy to operate stapler. However it means that the static force of the deflected spring will be particularly low since a less stiff spring is needed in the efficient design. If the spring cannot shear the front staple with static force, then the striker will remain atop the front staple with the spring energized. In this condition the device may be non-functional until the staple is ejected. Further the staple may eject unexpectedly.

It is desirable to reduce the force required to shear the front staple from a rack.

SUMMARY OF THE INVENTION

To overcome the strength of a glued bond it is familiar that peeling off portions of the bond until the entire bond is detached is easier than pulling at the entire bond at once. The same approach may be used to reduce the peak force required to shear the front staple of a rack.

According to one embodiment of the invention a staple track is structured with an asymmetric front-end support for the staple rack. This structure allows the front staple to be peeled off from one end to another rather than to be sheared all at once from the second staple. The individual staples lie side-to-side across the width of the track. The front of the track is lowered under one side of the forward most staples. Therefore the forward staples are fully supported by only one side of the track at only one side of each staple.

If the striker presses the front staple the unsupported sides of the forward group of staples will move down slightly while the sides supported by the track cannot move and remain in a higher position. The staple rack can flex slightly at the forward staples because of the resiliency of the glue that holds them together. One edge of the striker will press the higher side of the front staple while it will not press the lower side of the front staple. The higher side will thus begin to peel away from the adjacent second staple while the front and second staple move down slightly together at the unsupported side. At a predetermined position the second staple contacts the lowered side of the track and the remaining portion of the front staple is fully sheared from the second staple.

According to the above structure the force required to separate a front staple from a staple rack is greatly reduced. Therefore a low force spring can cause such a separation even when pressing statically. When used in a direct action stapler the reduced separation force will be provide an easier operation.

Although the action with slow movements causes asymmetric positions of the staples, under normal fast operation the front staple shears off instantly with no ill effects upon the operation of the stapler. The action occurs quickly enough that the staple rack has no time to flex or twist.

DETAILED DESCRIPTION OF THE INVENTION

Figure 1:
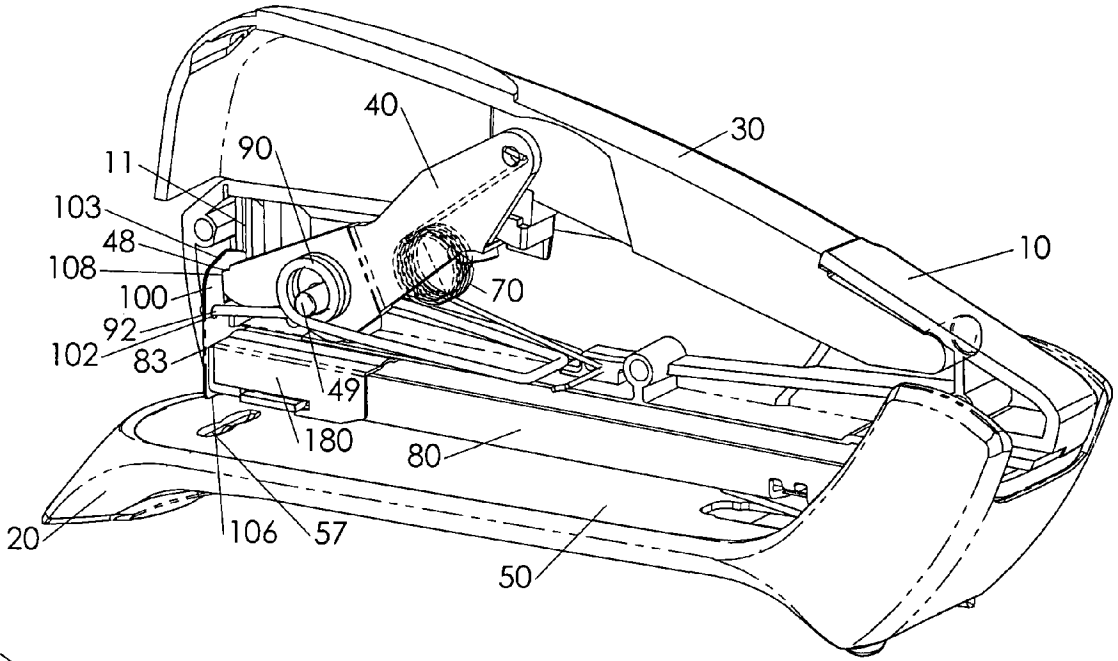
FIG. 1 is a rear-left side perspective view of a spring-actuated stapler with the left housing half removed, and the handle partly in section.
Figure 2:
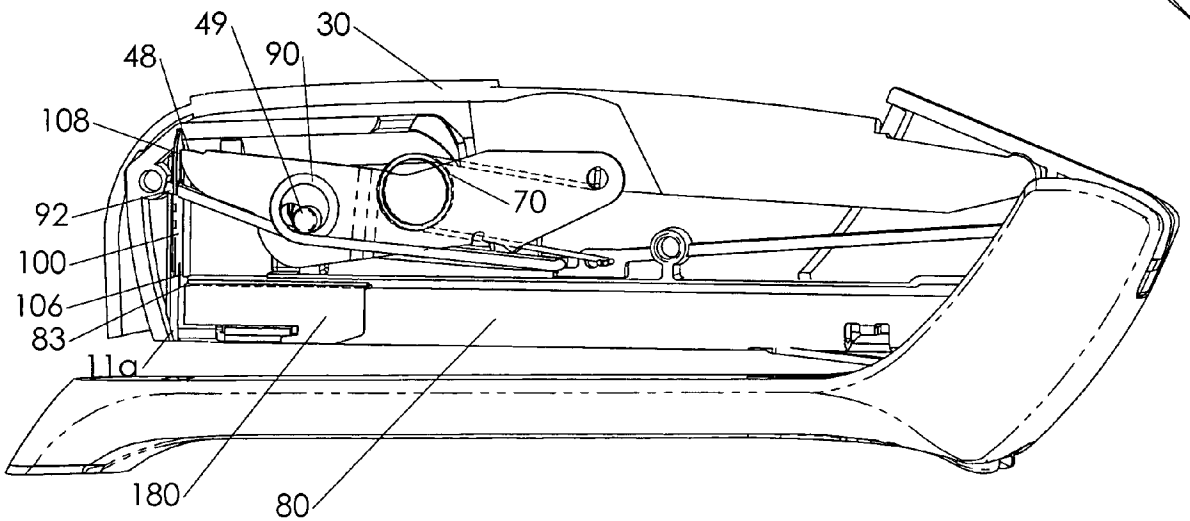
FIG. 2 is a side elevation of the stapler of FIG. 1, with the mechanism in a prerelease position.
Figures 3, 4, 5, 6:
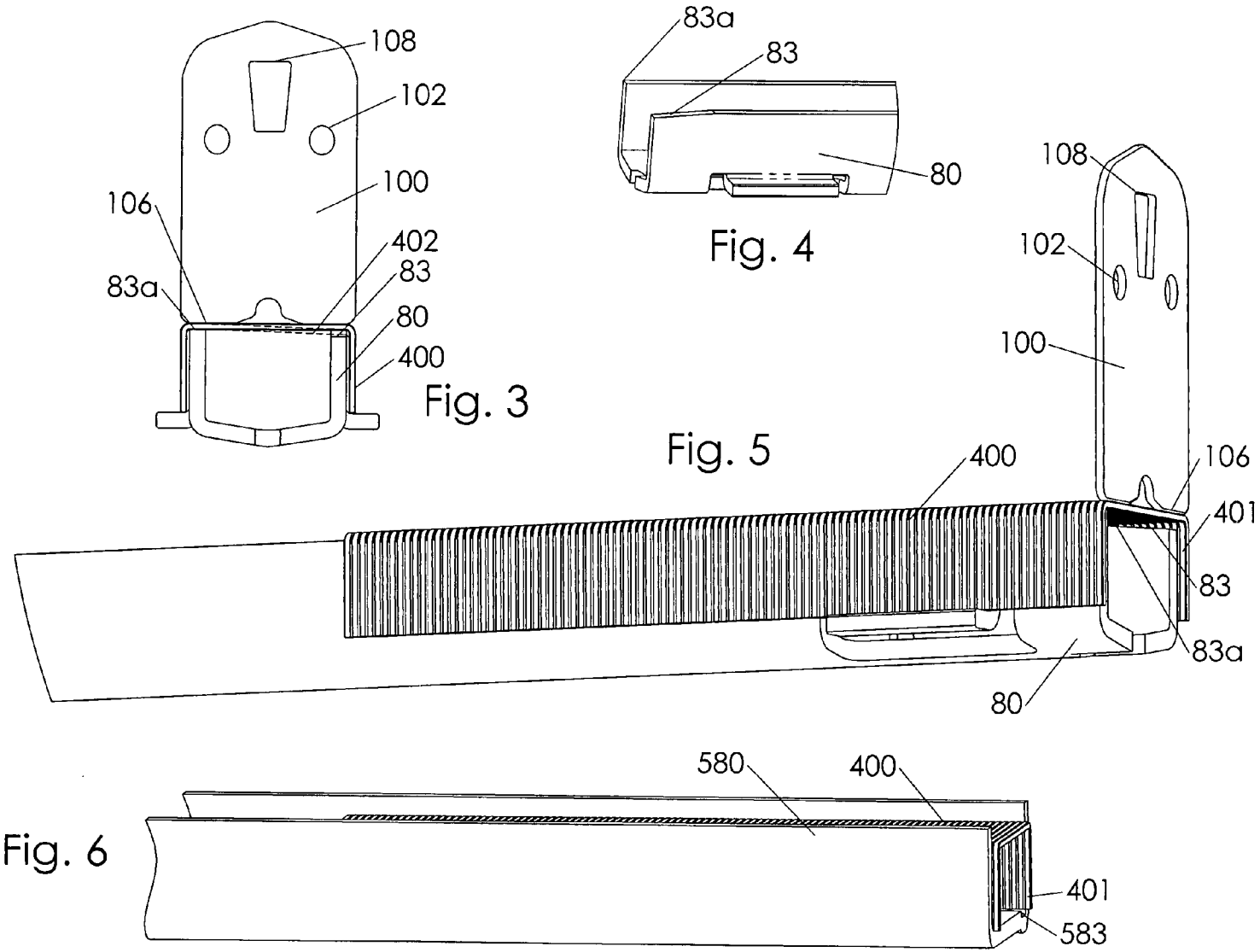
FIG. 3 is a front view of a striker, track and staple rack, with the striker pressing the front staple.
FIG. 4 is a front-left side perspective view of a front detail portion of a track according to the invention.
FIG. 5 is a front-right side perspective view of the assembly of FIG. 3.
FIG. 6 is a front-right side view of a staple track with a staple rack according to an alternate embodiment of the invention.

FIGS. 1 and 2 show a spring actuated desktop stapler as disclosed in co-pending U.S. patent application Ser. No. 10/443,854. In FIG. 1 the stapler is in a rest position. Body 10 is shown with the left side removed. Handle 30 pivots about body 10 toward the lower handle position shown in FIG. 2. Body 10 is pivotally mounted to base 20 whereby the front end of body 10 can pivot toward base 20. Cover plate 50 is fitted to base 20 and includes staple forming anvil 57. Lever 40 is linked to handle 30 at a rear lever end and to striker 100 at lever front end 48. Lever front end 48 engages slot 108, FIG. 3, of striker 100. When handle 30 is lowered lever 40 rotates clockwise in FIGS. 1 and 2 so that striker 100 moves upward. At the lever upper position shown in FIG. 2 lever front end 48 is just disengaged from striker slot 108. Striker 100 then instantly moves downward and ejects a staple out by an impact blow. Track 80 includes two parallel rails 88, FIG. 4, that hold and guide staples at top edges of the rails from within rack 400, FIGS. 3 and 5, while pusher 180 urges the staples toward striker 100, FIGS. 1 and 2. FIG. 6 shows an alternate embodiment track 580 where rack 400 is held within a channel of track 580. In FIGS. 1 and 2 the track is shown without staples. Striker 100 moves vertically in guide channel 11 including a lower most striker position at staple ejection slot 11*a*.

Power spring 90 is shown as a double torsion coiled spring in FIGS. 1 and 2, with one coil in front of lever 40 and another, not shown, hidden behind the lever. Power spring 90 pivots about a fulcrum at pin 49. Front arm 92 of the power spring fits into openings 102 of striker 100. Power spring 90 is biased to force striker 100 downward; this force is greatest when the striker is in the raised position of FIG. 2, where power spring 90 is most deflected. Other types of springs may be used such as single coil torsion springs, flat springs, and linear acting springs, where the spring is linked to the striker to bias the striker downward. Reset spring 70 raises lever 40 and handle 30 from the position of FIG. 2, but after the striker is released, to the position of FIG. 1.

In FIGS. 3 and 5 striker bottom edge 106 is shown in contact with the top surface of staples of staple rack 400. In FIG. 5 front most staple 401 extends beyond the front of track 80 and is positioned under striker 100. Staple 401 is within guide channel 11 of body 10, however body 10 with the guide channel is not shown in FIGS. 3 to 6 for simplicity. To reliably allow a staple to move under the striker, the striker should be raised to the position shown in FIG. 2, this is higher than shown in FIG. 5. In FIG. 2 striker bottom edge 106 is spaced well above the track at the release point shown. After the release the striker will instantly move down from the urging of spring 90 to impact staple 401. The staple is easily sheared from rack 400 by tearing of the glue bond that holds the staples together. Staple 401 is ejected out of staple ejection slot 11*a*.

However it is possible that a user will not press the handle down all the way to the release point. The user could release the handle before a staple advances into guide channel 11. This would represent a highest striker position lower than shown in FIGS. 3 and 5. In this case the striker would slowly return to its rest position of FIG. 1 as handle 30 is raised with no effect on any staples of rack 400.

Another possibility is that handle 30 is pressed down just far enough that striker 100 reaches the position of FIGS. 3 and 5. Since this is lower than the release point of FIG. 2, lever 40 will not disengage, or release, striker 100. The user removes pressure from the handle and striker bottom edge 106 rests on front staple 401. Lever front end 48 may disengage striker slot 108 at this point, so there is no further option to raise and release striker 100 in this operating cycle.

The force on staple 401 is limited to the static force created by deflected spring 90; there is no impact force. If spring 90 is of light duty it is possible that staple 401 will not shear off from rack 400. Rather striker 100 will stay in the upper position and spring 90 will remain energized. This is undesirable since staple 401 could eject unexpectedly at some later time as the staple rack glue bond fails.

A second staple is the staple immediately adjacent to and behind front most staple 401. Therefore when staple 401 is described as separating from the rack it more precisely means separating from the second staple of the rack. In the above scenario the glue bond holding staple 401 to the second staple of the rack must be sheared all at once since staple 401 moves straight down. If the glue can be sheared in locally progressing sections in a peeling action the peak force to shear the staple will be significantly reduced. The required force is limited to just the glue section that is being sheared at a given moment. In FIGS. 3, 4 and 5, track 80 is asymmetric at its front end. The front several staples of rack 400 are supported only by non-lowered front corner 83*a* of a first rail. The staples are not supported on the second rail at the location of chamfered front corner ramp 83, right side in FIG. 3. Preferably ramp 83 leads upward and rearward to a gradual merge with rail 88. If ramp 83 is very short the front several staples may comprise only the second staple.

In FIG. 3, staple 401 is in the same position on track 80 as staple 401 of FIG. 5; both are in guide channel 11. In FIG. 3 striker 100 is pressing rack 400 through staple 401 so that the front several staples of the rack are deflected downward. The rack twists slightly with undersides of the staples approximately following the contour of ramp 83. This twisting is shown as a dashed line for staple 401 in FIG. 3. As striker 100 continues to move down, striker bottom edge 106 creates a concentrated shearing force on staple 401 at non-lowered corner 83*a*, left side in FIG. 3. Staple 401 begins to separate from rack 400 from the left side. The right side of staple 401 remains attached to the lowered right side of rack 400. As striker 100 continues to move down the, underside of the second staple contacts the front corner of ramp 83, right side in FIG. 3. The right side of staple 401 is finally sheared from rack 400. According to the above description the glue holding staple 401 to rack 400 has been sheared from left to right in FIG. 3. By forming ramp 83 as a shallow gradual shape the ramp provides some support for the front several staples. These staples can remain attached to each other by the resilient glue even as they moving in relation to each other to create the twisted shape of the front of rack 400.

It is possible that the shear force to separate staple 401 may be low enough that staple 401 may be fully sheared from rack 400 before there is any contact with the front corner of ramp 83. In this case the force to twist rack 400 is by itself sufficient to complete the peeling action that finally detaches staple 401.

In the above discussion handle 30 is being raised slowly, so staple 401 is sheared off by a slow action of spring 90. As handle 30 is fully raised staple 401 is slowly pushed out from guide channel 11 through staple ejection slot 11*a*.

In FIG. 6 an alternate embodiment track is shown. Track 580 is a channel similar to track 80, but wider so that rack 400 can fit within rather than upon the track. This type of track is very common in conventional desktop staplers. A staple pusher, not shown, fits in the channel of track 580 and urges rack 400 forward under a spring bias using well-known structures. In FIG. 6 staple 401 extends out from within track 580 so that the staple is aligned with a striker, not shown, in the same manner as described for track 80. In track 580 the staples are supported at the bottom of the channel of track 580 by the bottom tips of the staple legs rather than by the staple undersides. Ramp 583 comprises a recess or cutout at the front of the channel bottom. The ramp is formed under one side of the staple legs of the front several staples. The front several staples of rack 400 are not supported on one side while the other side of these staples contacts the bottom of the channel of track 580. Therefore the rack will twist and staple 401 will be peeled from the rack in the same manner as for track 80 when a striker is slowly lowered upon staple 401. Track 580 normally includes additional components, not shown, to form an assembly to hold and guide track 580 within a stapler.

Ramps 83 or 583 may be of different particular shapes. For example they may include a stepped or notched transition, or be of an arcuate profile.

In either design for a track, staples of a rack are supported on a first and a second respective staple side by first and second support surfaces of the track or a track assembly. In track 80 the support surfaces are two rails extending up into rack 400 to contact each side of the undersides of staples. In track 580 the support surfaces are each side of a channel bottom that supports the bottom tips of the legs at each side of the staples. At the location of ramp 83 or 583, the staples are supported by only one of the staple support surfaces.

Figure 7:
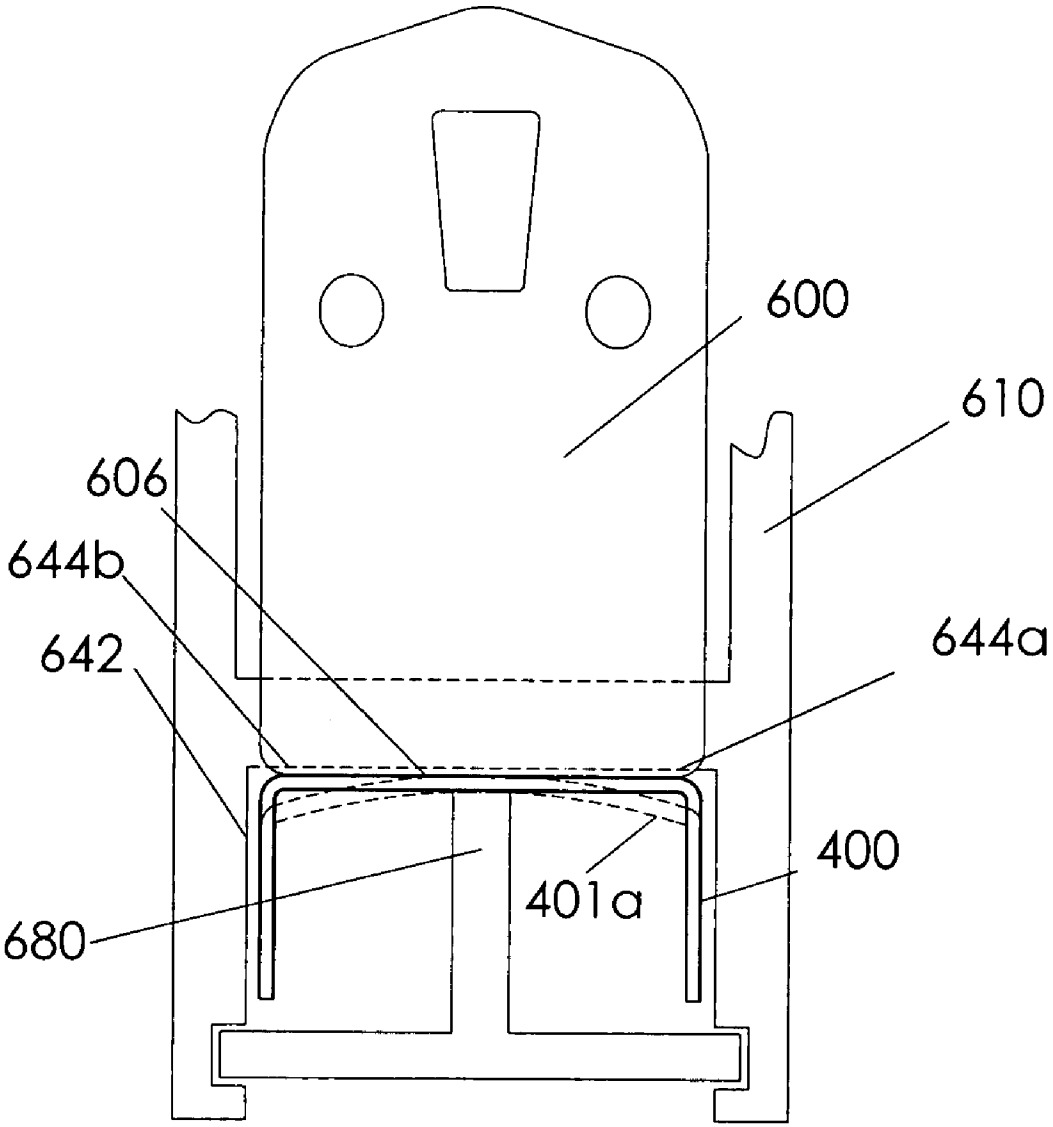
FIG. 7 is a front view, partly in section, of staples on a track in a track chamber, according to an alternate embodiment of the invention.

In a further alternate embodiment, FIG. 7, a symmetric design uses a single rail track 680 to support the staple centrally on the top edge of the rail between the staple sides. Track 680 fits within chamber 642 of housing 610. Rack 400 is held in position from atop at each side by ceiling corner 644*a* and opposite corner 644*b* of the chamber, where the ceiling contacts the first and second sides of the staples from above. As bottom edge 606 of striker 600 presses the staples, the front several staples of rack 400 will bend as shown by the exaggerated bend of the dashed line of front staple 401*a*. Staple 401*a* will begin to peel from the center since the force is concentrated here. The outer sides of front staple 401*a* deflect and move down along with the second staple of rack 400 before the outer sides begin to shear. The glue will be sheared in locally progressing sections in a peeling action that starts in the center and progresses toward each side. In this case the top of the staple is sheared first and the legs are sheared last, since the legs are farthest from the center of staple 401*a*. As seen in FIG. 7, there is a space below the staple legs so that at least the front several the staples are not supported on either side by an under-surface below the staples.

The invention claimed is:

1. A stapler including a body, a staple track extending from a front to a rear of the body within a staple chamber, a striker at a front of the chamber, wherein:

the track includes a staple support surface to hold and guide a staple rack upon the staple support surface, the staple support surface including a first supporting surface for a first staple side and a second supporting surface for a second staple side;

a front of the track being asymmetric where a front portion of the second supporting surface includes a ramp that is lowered so that a front several staples of the rack are supported by only the first supporting surface.

2. The stapler of claim 1 wherein the staple rack comprises individual staples that are glued together, the staple rack is positioned on the track, and a front most staple extends beyond the front of the track into a striker guide channel, the striker presses down upon the front most staple, the staple rack becoming twisted whereby the striker presses the front most staple at a first side of the front most staple and does not press the front most staple at a second side of the front most staple.

3. The stapler of claim 2 wherein the front most staple is sheared from the rack by shearing locally progressing sections of glue, the glue sections progressing from the first side of the staple toward the second side of the staple.

4. The stapler of claim 1 wherein the staple rack comprises individual staples that are glued together, the front several staples are positioned on the track, a first side of each of the front several staples being supported by the track, and a second side of each of the front several staples being spaced above the ramp.

5. The stapler of claim 1 wherein the staple support surface includes top edges of parallel rails of the track, a first rail including the first supporting surface and a second rail including a second supporting surface, and the ramp includes a front chamfered corner at a front of the second rail.

6. The stapler of claim 1 wherein the staple support surface includes a bottom of a channel of the track, a first side of the channel bottom including the first supporting surface and a second side of the channel bottom including the second supporting surface, the ramp including a recess in the second side of the channel bottom at a front of the channel bottom.

7. A stapler including a body, a staple track extending from a front to a rear of the body within a staple chamber, a striker at a front of the chamber, wherein:

the track includes a staple support surface to hold and guide a staple rack upon the staple support surface, the staple support surface includes top edges of parallel rails of the track, a first rail including a first supporting surface and a second rail including a second supporting surface;

a front of the track being asymmetric where a front portion of the second rail includes a ramp that is lowered so that a front several staples of the rack are supported by only the first rail.

8. The stapler of claim 7 wherein the staple rack comprises individual staples that are glued together, the staple rack is positioned on the track, and a front most staple extends beyond the front of the track into a striker guide channel, the striker presses down upon the front most staple, the staple rack becoming twisted whereby the striker presses the front most staple at a first side of the front most staple and does not press the front most staple at a second side of the front most staple.

9. The stapler of claim 8 wherein the front most staple is sheared from the rack by shearing locally progressing sections of glue, the glue sections progressing from the first side of the staple toward the second side of the staple.

10. The stapler of claim 7 wherein the staple rack comprises individual staples that are glued together, the front several staples are positioned on the rack, a first side of each of the front several staples being supported by the track, and a second side of each of the front several staples being spaced above the ramp.

11. A stapler including a body, a staple track extending from a front to a rear of the body within a staple chamber, a striker at a front of the chamber, wherein:

the track includes a staple support surface to hold and guide a staple rack upon the staple support surface, the staple support surface includes a bottom of a channel of the track, a first side of the channel bottom including a first supporting surface and a second side of the channel bottom including a second supporting surface;

a front of the track being asymmetric where a front portion of the of the second side of the channel bottom includes a ramp that is lowered so that a front several staples of the rack are supported by only the first side of the channel bottom;

the ramp includes a recess in the second side of the channel bottom at a front of the channel bottom.

12. The stapler of claim 11 wherein the staple rack comprises individual staples that are glued together, the staple rack is positioned on the track, and a front most staple extends beyond the front of the track into a striker guide channel, the striker presses down upon the front most staple, the staple rack becoming twisted whereby the striker presses the front most staple at a first side of the front most staple and does not press the front most staple at a second side of the front most staple.

13. The stapler of claim 12 wherein the front most staple is sheared from the rack by shearing locally progressing sections of glue, the glue sections progressing from the first side of the staple toward the second side of the staple.

14. The stapler of claim 11 wherein the staple rack comprises individual staples that are glued together, the front several staples are positioned on the rack, a first side of each of the front several staples being supported by the track, and a second side of each of the front several staples being spaced above the ramp.

* * * * *